US010357815B2

(12) United States Patent
Okuzumi et al.

(10) Patent No.: US 10,357,815 B2
(45) Date of Patent: Jul. 23, 2019

(54) PRESS DRAWING METHOD

(71) Applicant: HONDA MOTOR CO., LTD., Tokyo (JP)

(72) Inventors: Syohei Okuzumi, Tochigi (JP); Koji Fujita, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 234 days.

(21) Appl. No.: 14/791,305

(22) Filed: Jul. 3, 2015

(65) Prior Publication Data

US 2016/0067758 A1 Mar. 10, 2016

(30) Foreign Application Priority Data

Sep. 9, 2014 (JP) ..... 2014-183126

(51) Int. Cl.
*B21D 22/20* (2006.01)

(52) U.S. Cl.
CPC ..... *B21D 22/20* (2013.01)

(58) Field of Classification Search
CPC ..... B21D 22/20; B21D 22/21
See application file for complete search history.

(56) References Cited

U.S. PATENT DOCUMENTS 2,308,471 A * 1/1943 Schwartz ..... B21D 51/40 29/557

FOREIGN PATENT DOCUMENTS

| | | |
|---|---|---|
| JP | 58-128229 | 7/1983 |
| JP | 11-221627 | 8/1999 |
| JP | 2012-071388 | 4/2012 |

* cited by examiner

*Primary Examiner* — Teresa M Ekiert
(74) *Attorney, Agent, or Firm* — Rankin, Hill & Clark LLP

(57) ABSTRACT

A press drawing method includes a first step for moving an upper mold 10*e* from a top dead center to a fracture position and applying a predetermined strain to a part of a plate material 1 to be drawn, causing the plate material 1 to fracture at a fracture part 4, and a second step for moving the upper mold 10*e* from the fracture position to a bottom dead center, thus completing the drawing process.

4 Claims, 7 Drawing Sheets

PRESS DRAWING METHOD

BACKGROUND OF THE INVENTION

Field of the Invention

The present invention relates to a press drawing method for pressing and drawing a plate material by a metal mold.

Description of the Related Art

Hitherto, as a press drawing method mentioned above, there has been known a method that allows molding to be achieved without causing a fracture at a corner of a frame-like pattern surrounded by a ridge, such as a window frame of a door inner panel, even if the drawing depth is large to a certain extent (refer to, for example, Japanese Patent Application Laid-Open No. 2012-71338 (hereinafter referred to as "Patent Document 1").

According to the method described in Patent Document 1, in the press drawing process, the feeding of a plate material from a part corresponding to the inner side of the frame-like pattern to a part corresponding to the inner wall of a corner part is facilitated thereby to prevent the corner part from being fractured.

In order to facilitate the feeding of the plate material, a plurality of fracture parts, such as holes, slits or thin-wall parts, are formed in advance in an area of the plate material that corresponds to the inner side area of the frame-like pattern. An appropriate quantity, appropriate positions and appropriate shapes of such fracture parts are selected to control the feeding such that the part of the plate material corresponding to the area in the vicinity of the straight part of the frame-like pattern will wrap around a part corresponding to the corner part.

When the area corresponding to the inner side area of the frame-like pattern is provided with the fracture parts and the press drawing process is implemented according to the molding method described in Patent Document 1, the tension applied to the part where the frame-like pattern is to be formed decreases. This may result in an insufficient strain being applied to the part to be formed, causing the part to fail to develop required shape fixability. The result may be deteriorated molding accuracy. In other words, providing the inner side area of the frame-like pattern with the fracture parts is not desirable for applying a sufficient strain for obtaining the shape fixability to the part to be formed.

However, in order to protect the corner parts from fractures without providing the inner side area of the frame-like pattern with the fracture parts, a majority of the plate material for forming the frame-like pattern would be supplied from the outer side of the part corresponding to the frame-like pattern. This would result in an increased area of the plate material on the outer side of the frame-like pattern, leading to a lower yield.

SUMMARY OF THE INVENTION

The present invention has been made toward solving the problem with the prior art described above, and an object of the invention is to provide a press drawing method that makes it possible to achieve both required shape fixability and improved yield.

A press drawing method in accordance with the present invention is a press drawing method in which a metal mold is moved from a first position to a second position in a state in which a first part of a plate material is grasped, and a second part apart from the first part of the plate material is pressed by the metal mold thereby to draw the second part, the method including: a first step for moving the metal mold from the first position toward the second position until a fracture position at which a fracture is to occur between the first part and the second part of the plate material and for applying a predetermined strain to a part of the plate material to be drawn, thereby causing the fracture to occur; and a second step for moving the metal mold from the fracture position to the second position after the first step, thus completing the drawing of the second part.

According to the present invention, in the first step, while the metal mold is being moved to the fracture position, a predetermined strain is applied by a tension, which is applied by the metal mold, to the second part of the plate material that is to be drawn. The predetermined strain corresponds to a strain that imparts desired shape fixability to the second part. The strain ranges, for example, from 1.5% to 2%, which indicates the ratio of length of a resultant distortion to a length before the strain is applied.

Further, the fracture of the plate material in the first step makes it easy to feed the plate material to the second part from the fracture part side. When the drawing is progressed in such a state in the second step, the plate material is easily fed to the second part from the fracture part side, so that the amount of the plate material fed to the second part from the side opposite from the fracture part will be reduced accordingly, as compared with the case where no fracture occurs at the fracture part. This makes it possible to reduce the size of the plate material according to the reduced feed amount of the plate material, thus permitting a higher yield.

According to the present invention, therefore, the required shape fixability can be obtained and a higher yield can be achieved at the same time. Setting the fracture part at an area of the plate material that is to be discarded makes it possible to protect the molding from being affected by the fracture occurring at the fracture part.

In the present invention, a pair of slits or a plurality of open holes may be provided in the plate material before or during the first step so as to form a fracture part, in which the fracture occurs in the first step, in an area sandwiched between the pair of slits or an area sandwiched between adjacent open holes among the plurality of open holes.

With this arrangement, selecting the positions, sizes or shapes of the slits or the open holes makes it possible to control the position, the size or the shape of the fracture part or the timing of the fracture (the timing of the shift from the first step to the second step). This makes it possible to properly set the amount of the plate material to be fed to the second part from the fracture part side in the first step and the second step, or the amount of the strain to be applied to the second part in the first step.

In the present invention, the second part may be composed of a shallow drawing part and a deep drawing part; the drawing of the second part may be carried out such that the shallow drawing part is drawn to a first depth and the deep drawing part is drawn to a second depth, which is deeper than the first depth; and the shallow drawing part may be adjacent to the fracture part side of the deep drawing part.

With this arrangement, the plate material is easily fed from the fracture part side to the deep drawing part via the shallow drawing part, thus suppressing accordingly the feeding of the plate material to the deep drawing part from the opposite side from the fracture part. This makes it possible to further reduce the amount of the plate material on the opposite side from the fracture part relative to the second part, so that a still higher yield can be achieved.

In the present invention, the plate material is machined to a molding that has an opening and a frame-like pattern that encloses the opening. The frame-like pattern may be formed by the drawing, and the fracture part may be positioned at an area of the plate material that turns into the opening.

With this arrangement, the plate material is easily fed to a part corresponding to the frame-like pattern from the inner side thereof in the second step, so that the amount of the plate material fed to the part corresponding to the frame-like pattern from the outer side thereof can be reduced. As a result, the molding described above can be obtained using a plate material with a smaller area, thus allowing the yield to be improved.

In the present invention, the frame-like patterns may be formed on the plate material such that a plurality of openings of the moldings are adjacent to each other, sandwiching corresponding frame-like patterns.

With this arrangement, in the case where a plurality of moldings are obtained from a single plate material, the plate material is easily fed to parts which are to become corresponding frame-like patterns from parts which are to become openings of the moldings in the second step, thus making it possible to set a smaller distance between plate material parts corresponding to the moldings. As a result, a plurality of moldings can be produced using a plate material with a smaller area, permitting a still higher yield.

DESCRIPTION OF THE PREFERRED EMBODIMENTS

Figure 1:
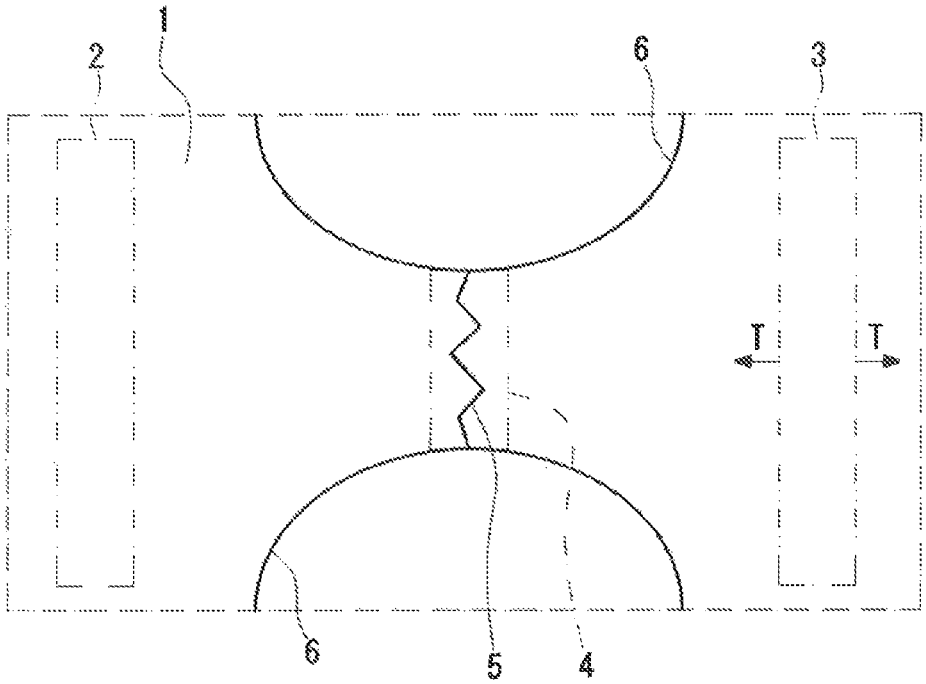
FIG. 1 is a plan view illustrating the parts on a plate material formed by the press drawing method according to an embodiment of the present invention.

An embodiment of the present invention will be described below with reference to the accompanying drawings. According to the press drawing method of the present embodiment, with a first part 2 of a plate material 1 grasped, a metal mold (not illustrated) is moved from a first position to a second position to carry out pressing, thereby drawing a second part 3 of the plate material 1, as illustrated in FIG. 1. The press drawing of the second part 3 is carried out by moving an upper mold from a top dead center, which is the first position, to a bottom dead center, which is the second position, with respect to a lower mold of the metal mold.

Slits 6 are formed in the plate material 1 in advance such that a fracture 5 occurs at a fracture part 4 between the first part 2 and the second part 3 when the upper mold moves from the top dead center to the fracture position between the top dead center and the bottom dead center. The positions of the slits 6 are set between the first part 2 and the second part 3 of the plate material 1 and set at different positions from the position of the fracture part 4 in a direction intersecting with the direction from the first part 2 toward the second part 3. The slits 6 may alternatively be provided while the upper mold is moving toward the fracture position (i.e. in the middle of a first step, which will be discussed hereinafter).

Figure 2:
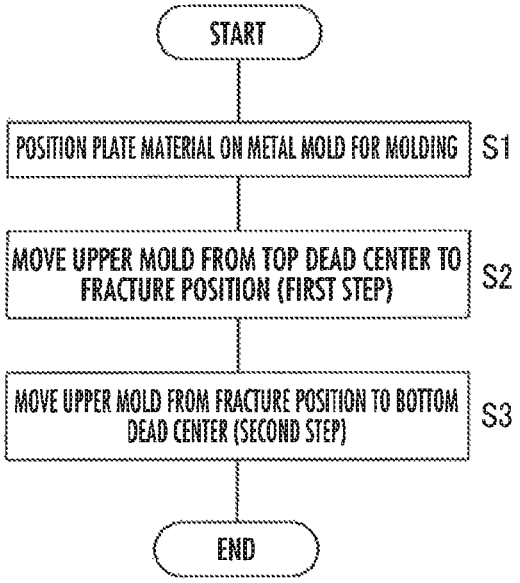
FIG. 2 is a flowchart illustrating the process according to the press drawing method.

To carry out the press drawing process, the plate material 1 is first positioned with respect to the metal mold (step S1), as illustrated in FIG. 2. Then, a first step is carried out, in which, with the first part 2 of the plate material 1 grasped, the upper mold of the metal mold is moved from the top dead center to the fracture position between the top dead center and the bottom dead center (step S2).

In the first step, the first part 2 is grasped and the second part 3 is drawn while being pressed by the upper mold against the lower mold, so that a tension T acts on the second part 3. This generates a strain (e.g. 1.5% to 2%) that imparts appropriate shape fixability to the second part 3.

Then, when the upper mold reaches the fracture position and the fracture 5 takes place in the fracture part 4, the first step is completed, and the process proceeds to a second step. At this time, the occurrence of the fracture 5 makes it easy for the plate material 1 to be fed from the fracture part 4 side to the second part 3, which is to be drawn.

In the second step, the upper mold is moved from the fracture position to the bottom dead center in the foregoing state. Meanwhile, the plate material 1 is easily fed from the fracture part 4 side toward the second part 3, thus reducing the feed of the plate material 1 to the second part 3 from the side opposite from the fracture part 4. When the upper mold reaches the bottom dead center, the second step is ended, completing the drawing process.

Thus, the strain imparted in the first step makes it possible to obtain the shape fixability required for securing desired molding accuracy after the molding process is completed. Further, in the second step, the plate material 1 is easily fed from the fracture part 4 side to the second part 3, so that the amount of the plate material 1 fed to the second part 3 from the side opposite from the fracture part 4 is reduced, thus permitting a higher yield.

The slits 6 and the fracture part 4 are set in the areas of the plate material 1 that will be abandoned and therefore will not affect the molding to be obtained from the plate material 1 having subjected to the process. Further, even when the fracture 5 has not yet taken place in the first step, the presence of the slits 6 allows the plate material 1 to be fed to a certain extent from the fracture part 4 side to the second part 3.

Figure 3:
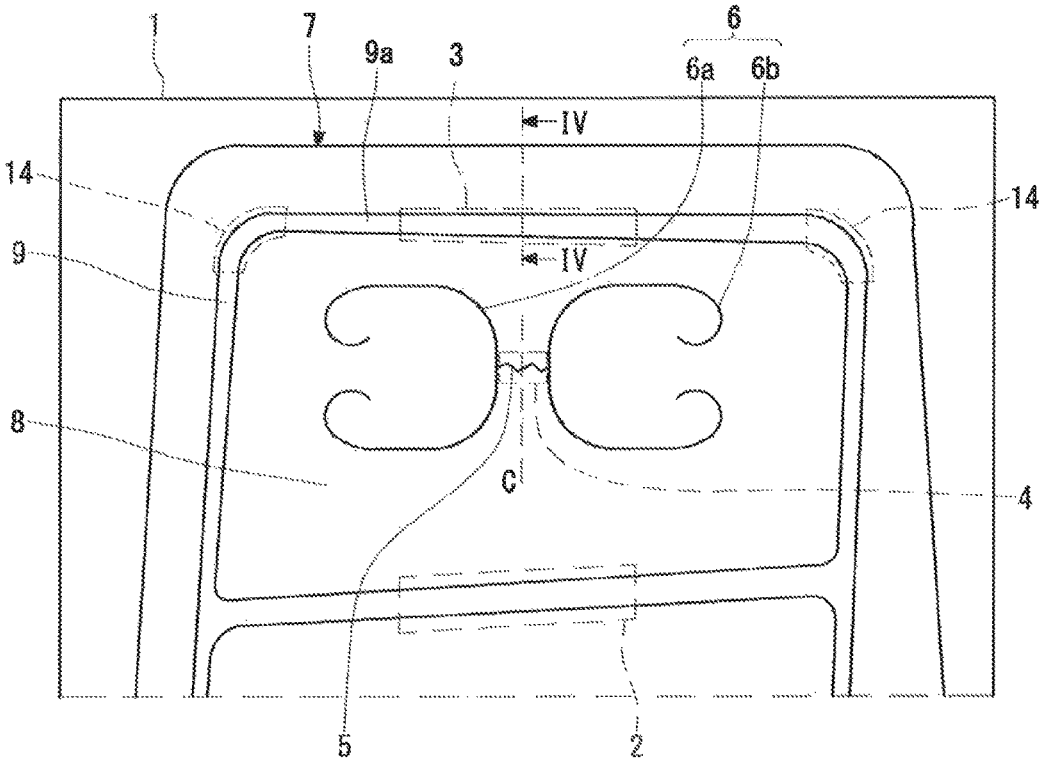
FIG. 3 is a plan view of a molding which has been formed by the process illustrated in FIG. 2 and which is to be machined to a door inner panel.

FIG. 3 illustrates the molding of the door inner panel formed on the plate material 1 as described above. The upper side of FIG. 3 is the roof side of the door inner panel. A molding 7 has, on the inner side thereof, an opening part 8, which will be an opening for a windowpane, and a frame-like pattern 9, which is formed to enclose the opening part 8.

The frame-like pattern 9 can be formed by the press drawing method illustrated in FIG. 2. In this case, the fracture part 4 and the slits 6 are set on the opening part 8. The foregoing second part 3 is located on a roof-side straight part 9*a* of the frame-like pattern 9.

Further, the part of the frame-like pattern 9 that opposes the second part 3 corresponds to the first part 2. In other words, when the frame-like pattern 9 is drawn by the process illustrated in FIG. 2, the first part 2 is formed by the upper mold and the lower mold and also grasped by the upper mold and the lower mold at the same time to function as the first part 2.

The slits 6 are composed of, for example, two slits 6*a* and 6*b*, which are disposed in a laterally symmetrical manner with respect to a centerline C in the vertical direction of the opening part 8, as illustrated in FIG. 3. Each of the slits 6*a* and 6*b* has a substantially circular shape with ends rolled inward at an open end, and the two open ends of the slits 6*a* and 6*b* are disposed, facing laterally outward away from each other. The area between the slits 6*a* and 6*b*, with the centerline C at the center thereof, provides the fracture part 4. In other words, the fracture part 4 is formed in the area sandwiched between the pair of the slits 6*a* and 6*b*.

Providing in advance the slits 6*a* and 6*b* shaped as described above makes it possible to properly draw the part corresponding to the second part 3 and other parts of the frame-like pattern 9 by moving the metal mold according to the process illustrated in FIG. 2.

FIG. 4A to FIG. 8B illustrate the states of the second part 3 of the molding 7 (FIG. 3) in each of an embodiment and a comparison example as the molding is progressed according to the process illustrated in FIG. 2. These drawings are sectional views taken at line IV-IV in FIG. 3. FIG. 4A, FIG. 5A, FIG. 6A, FIG. 7A, and FIG. 8A illustrate the comparison example in which the plate material 1 that does not have the slits 6 is molded. FIG. 4B, FIG. 5B, FIG. 6B, FIG. 7B, and FIG. 8B illustrate the present embodiment in which the plate material 1 that has the slits 6 formed therein is molded.

The metal mold used in the present embodiment has an upper mold 10*e* and a lower mold 11*e*, while the metal mold used in the comparison example has an upper mold 10*c* and a lower mold 11*c*. The metal mold used in the present embodiment and the metal mold used in the comparison example share the same configurations of the parts for molding the second part 3, whereas the configurations of the parts for molding a part adjacent to the roof side are slightly different, as will be discussed hereinafter.

Figure 4A:
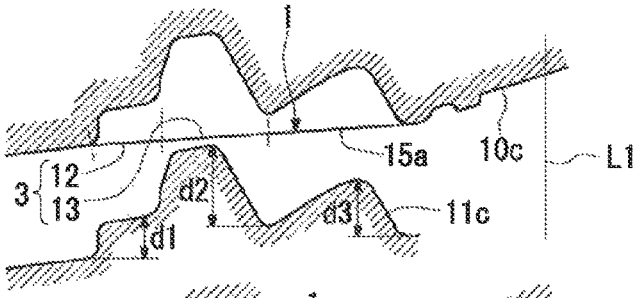
FIG. 4A is a sectional view illustrating the neighborhood of a second part of a plate material positioned on a metal mold in a comparison example of molding a plate material without slits, the example being a comparison example in contrast to the embodiment.
Figure 4B:
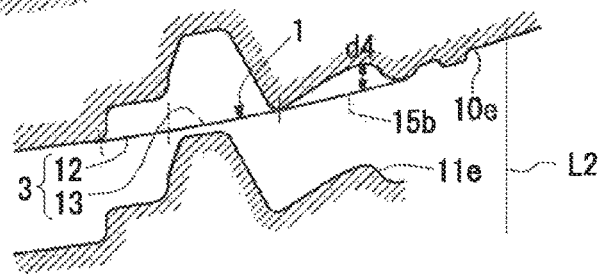
FIG. 4B is a sectional view illustrating the neighborhood of a second part of a plate material positioned on a metal mold in the case where a plate material provided with slits is molded according to the method of the embodiment.
Figure 5A:
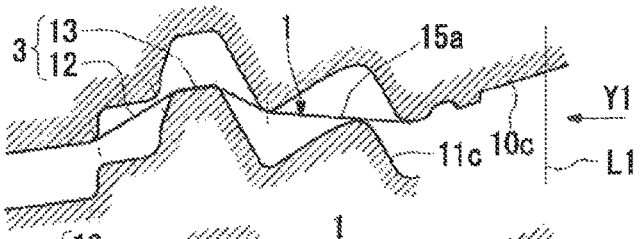
FIG. 5A is a sectional view illustrating the neighborhood of the second part when the molding process is started in the comparison example of FIG. 4A.
Figure 5B:
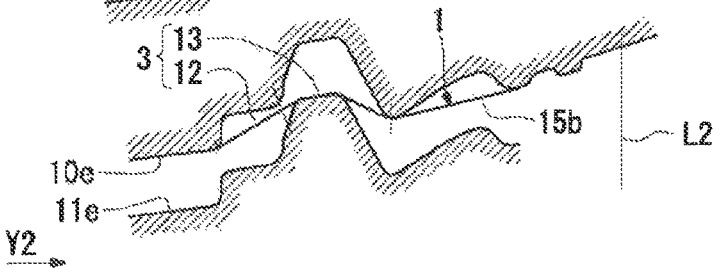
FIG. 5B is a sectional view illustrating the neighborhood of the second part when the molding process is started in the embodiment of FIG. 4B.

FIG. 4A illustrates the plate material 1 in the comparison example, which has been positioned with respect to the upper mold 10*c* and the lower mold 11*c* of the metal mold. FIG. 4B illustrates the plate material 1 in the present embodiment, which has been positioned with respect to the upper mold 10*e* and the lower mold 11*e* of the metal mold.

As illustrated in FIG. 4A and FIG. 4B, in both the comparison example and the embodiment, the second part 3 is composed of a shallow drawing part 12 and a deep drawing part 13, which is adjacent to the shallow drawing part 12 on the roof side. When drawing the second part 3, the shallow drawing part 12 is drawn to a first depth d1, and the deep drawing part 13 is drawn to a second depth d2, which is deeper than the first depth d1.

In the case of the comparison example illustrated in FIG. 4A, as the measures against wrinkles that tend to appear at corners 14 of the frame-like pattern 9 illustrated in FIG. 3, an outer drawing part 15*a* is set adjacently to the outer side of the deep drawing part 13 of the plate material 1. The outer drawing part 15*a* is drawn to a depth d3 equivalent to the second depth d2.

In contrast, according to the present embodiment, a drawing depth d4 of an outer drawing part 15*b* corresponding to the outer drawing part 15*a* is set to a value that is smaller than that of the drawing depth d3 of the outer drawing part 15*a*, as illustrated in FIG. 4B.

More specifically, the drawing depth d4 is set to a minimum value within a range in which a boundary area between a part of the upper mold 10*e* that corresponds to the deep drawing part 13 and a part thereof corresponding to the outer drawing part 15*b* does not come in contact with the second part 3 and the outer drawing part 15*b* of the plate material 1 before the rest of the upper mold 10*e* does. In FIG. 4A and FIG. 4B, the positions of the ends of the plate materials 1 on the roof side are indicated by lines L1 and L2.

In these states, when the upper mold 10*c* and the upper mold 10*e* in the comparison example and the present embodiment, respectively, are moved down to a position that is 25 mm above the bottom dead center, the second parts 3 of the plate materials 1 are pressed by the upper mold 10*c* and the lower mold 11*c* and by the upper mold 10*e* and the lower mold 11*e*, respectively. At this time, in the case of the comparison example without the slits 6, the feeding of the plate material 1 is started from the roof side to the second part 3, as indicated by an arrow Y1 in FIG. 5A. Thus, the second part 3 is molded while being stretched.

In contrast, in the case of the present embodiment, the provision of the slits 6 makes it easy to a certain extent to feed the plate material 1 from the fracture part 4 side to the second part 3. Hence, the feeding of the plate material 1 is started from the fracture part 4 side to the second part 3, as indicated by an arrow Y2 in FIG. 5B. Thus, the second part 3 is molded while being stretched.

Figure 6A:
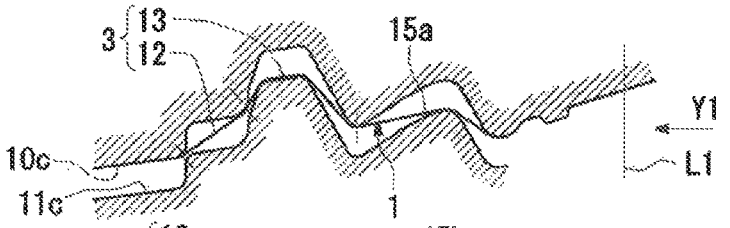
FIG. 6A is a sectional view illustrating the neighborhood of the second part when the molding process has progressed from the state illustrated in FIG. 5A in the comparison example.

When the upper molds 10*c* and 10*e* are moved down to a position that is 15 mm above the bottom dead center (the fracture position in the present embodiment), in the case of the comparison example, the feeding of the plate material 1 from the roof side to the second part 3 up to that point causes the position of the end of the plate material 1 on the roof side, which is indicated by the line L1, to be changed to the opposite side from the roof, as illustrated in FIG. 6A.

Figure 6B:
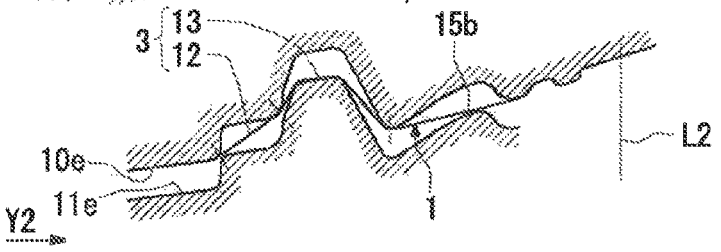
FIG. 6B is a sectional view illustrating the neighborhood of the second part when the molding process has progressed from the state illustrated in FIG. 5B and a fracture part of the plate material has fractured in the embodiment.

In contrast, in the case of the present embodiment, the position of the end of the plate material 1 on the roof side indicated by the line L2 remains unchanged, as illustrated in FIG. 6B. Then, the fracture 5 (FIG. 1) occurs at the fracture part 4 between the slits 6, thus making it further easier to feed the plate material 1 from the fracture part 4 side to the second part 3.

At this point, the application of a strain for imparting appropriate shape fixability to the second part 3 by the tension T (FIG. 1) applied to the second part 3 through the intermediary of the fracture part 4 before the fracture 5 occurs is completed. Thus, the first step illustrated in FIG. 2 is completed and the process proceeds to the second step.

Thereafter, when the upper molds 10*c* and 10*e* are moved further down, in the case of the comparison example, the feeding of the plate material 1 from the roof side to the second part 3 is continued. In the case of the present embodiment, the feeding of the plate material 1 from the fracture part 4 side to the second part 3 is continued. Hence, in both the comparison example and the present embodiment, the feeding of the plate material 1 to the second part 3 is smoothly carried out, progressing the molding process.

Figure 7A:
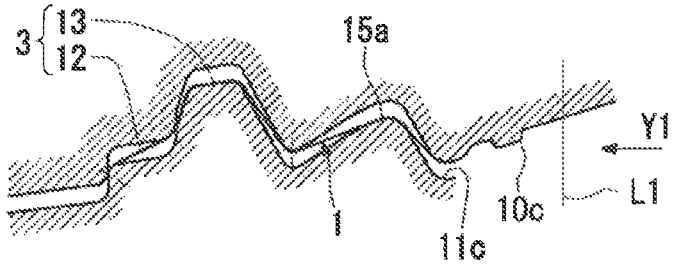
FIG. 7A is a sectional view illustrating the neighborhood of the second part when the molding process has further progressed from the state illustrated in FIG. 6A in the comparison example.
Figure 7B:
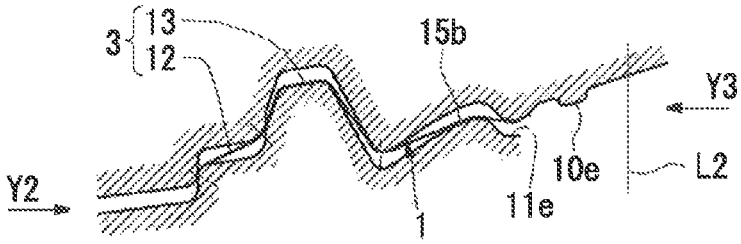
FIG. 7B is a sectional view illustrating the neighborhood of the second part when the molding process has further progressed from the state illustrated in FIG. 6B in the embodiment.

At the point when the upper molds 10*c* and 10*e* reach the position that is 5 mm above the bottom dead center, in the case of the comparison example illustrated in FIG. 7A, the feeding of the plate material 1 to the second part 3 from the roof side is continuing. In contrast, according to the present embodiment, the feeding of the plate material 1 to the second part 3 from the roof side (as indicated by an arrow Y3) is begun while the feeding of the plate material 1 to the second part 3 from the fracture part 4 side is continuing, as illustrated in FIG. 7B. Hence, in both the comparison example and the present embodiment, the feeding of the plate material 1 to the second part 3 is smoothly carried out, progressing the molding process without causing a crack.

Figure 8A:
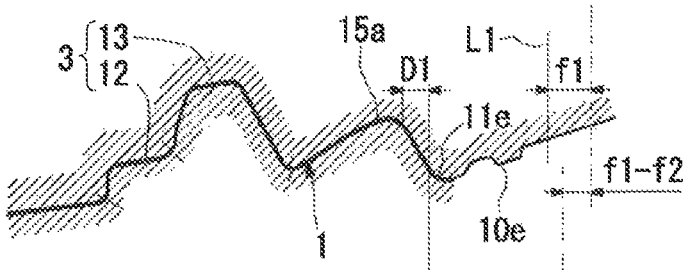
FIG. 8A is a sectional view illustrating the neighborhood of the second part when the molding process has been completed in the comparison example.
Figure 8B:
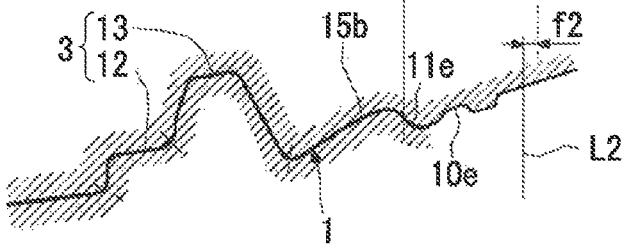
FIG. 8B is a sectional view illustrating the neighborhood of the second part when the molding process has been completed in the embodiment.

Then, when the upper molds 10*c* and 10*e* reach the bottom dead center, the molding is completed without developing a crack, as illustrated in FIG. 8A and FIG. 8B. At this time, it is assumed that, for example, a feeding amount f1 of the plate material 1 to the second part 3 from the roof side in the comparison example is 20 mm, and a difference D1 in length between an outer drawing part 15*a* in the comparison example and the outer drawing part 15*b* in the present embodiment is 10 mm. It is further assumed that a feeding amount f2 of the plate material 1 to the second part 3 from the roof side in the present embodiment is 5 mm.

In this case, according to the present embodiment, the difference in the amount of feeding of the plate material 1 to the second part 3 from the roof side between the comparison example and the present embodiment (f1-f2) will be 15 mm. The end part of the plate material 1 on the roof side can be cut down by 25 mm (15 mm plus D1).

Figure 9:
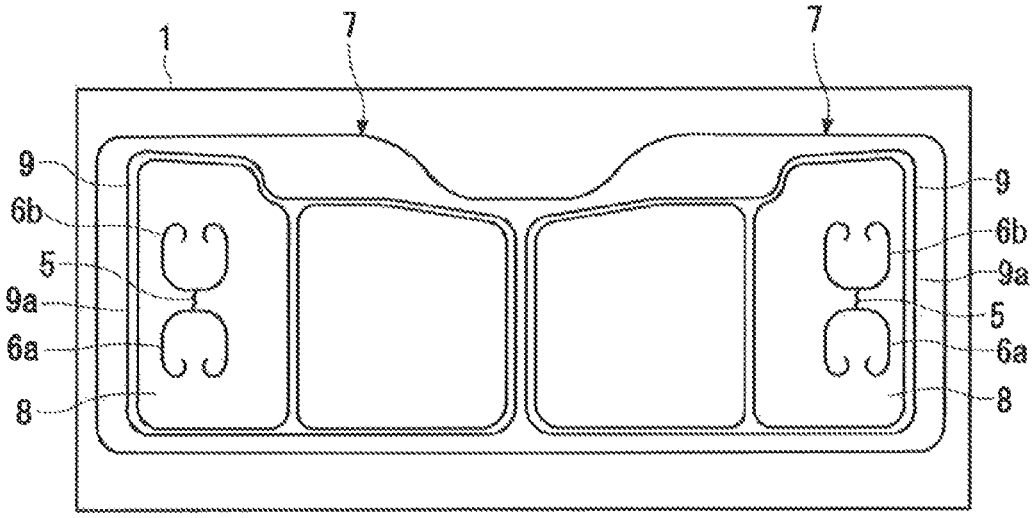
FIG. 9 is a plan view illustrating another example of the molding for a door inner panel that can be formed by the process illustrated in FIG. 2.

Further, the process for molding the door inner panel described above can be applied to mold the left and right door inner panels of a vehicle by using one plate material 1, as illustrated in FIG. 9. In this case, the molding is carried out such that the roof side of each of the door inner panels is disposed to an opposing end edge of the plate material 1, thus making it possible to reduce the dimension of the plate material 1 at the end edge on the roof side of the left and right door inner panels by a total of 50 mm. According to the present embodiment, therefore, the yield can be improved.

As described above, the present embodiment makes it possible to obtain the required shape fixability by applying the strain in the first step and to achieve a higher yield by the easy feeding of the plate material 1 to the second part 3 due to the fracture 5.

Further, the fracture part 4 is formed by the slits 6, so that the amount of feeding of the plate material 1 to the second part 3 from the fracture part 4 side or the amount of the strain to be applied to the second part 3 can be properly set by selecting appropriate positions, sizes or shapes of the slits 6.

Further, the second part 3 is composed of the shallow drawing part 12 and the deep drawing part 13, thus permitting the easy feeding of the plate material 1 to the second part 3 from the fracture part 4 side. This makes it possible to further improve the yield.

Further, as illustrated in FIG. 9, the left and right door inner panels are molded by the single plate material 1, and the frame-like pattern 9 thereof is formed in the process illustrated in FIG. 2. Therefore, the left and right door inner panels can be molded with a higher yield.

Figure 10:
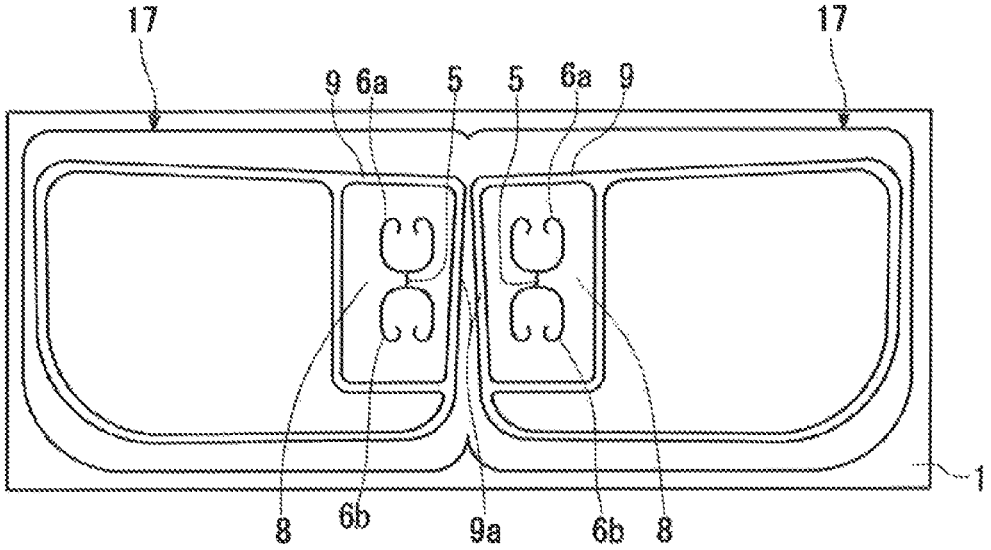
FIG. 10 is a plan view illustrating yet another example of the molding for a door inner panel that can be formed by the process illustrated in FIG. 2.

FIG. 10 illustrates another example of the molding of the door inner panel molded using the press drawing method illustrated in FIG. 2. In this example, moldings 17 of the left and right door inner panels are simultaneously formed with a single plate material 1. The moldings 17 are formed on the plate material 1 in such a manner that opening parts 8 thereof are disposed adjacently to each other, sandwiching roof-side straight parts 9*a* of frame-like patterns 9 corresponding thereto.

In this case also, the amount of the plate material 1 fed to the roof-side straight parts 9*a* (second parts 3) from the roof side can be reduced, thus making it possible to place the left and right moldings 17 closer to each other accordingly on the roof side in the molding process. This makes it possible to use the plate material 1 of a size that has been reduced accordingly, permitting a higher yield.

Although the present invention has been described with reference to the embodiment, the present invention is not limited thereto. For example, the fracture part 4 may alternatively be formed of an open hole or the like in place of the slits 6, insofar as the alternative allows the sufficient tension T to be applied to the second part 3 and is also sufficiently fragile to be fractured when the upper mold 10*e* reaches the fracture position.

Figure 11:
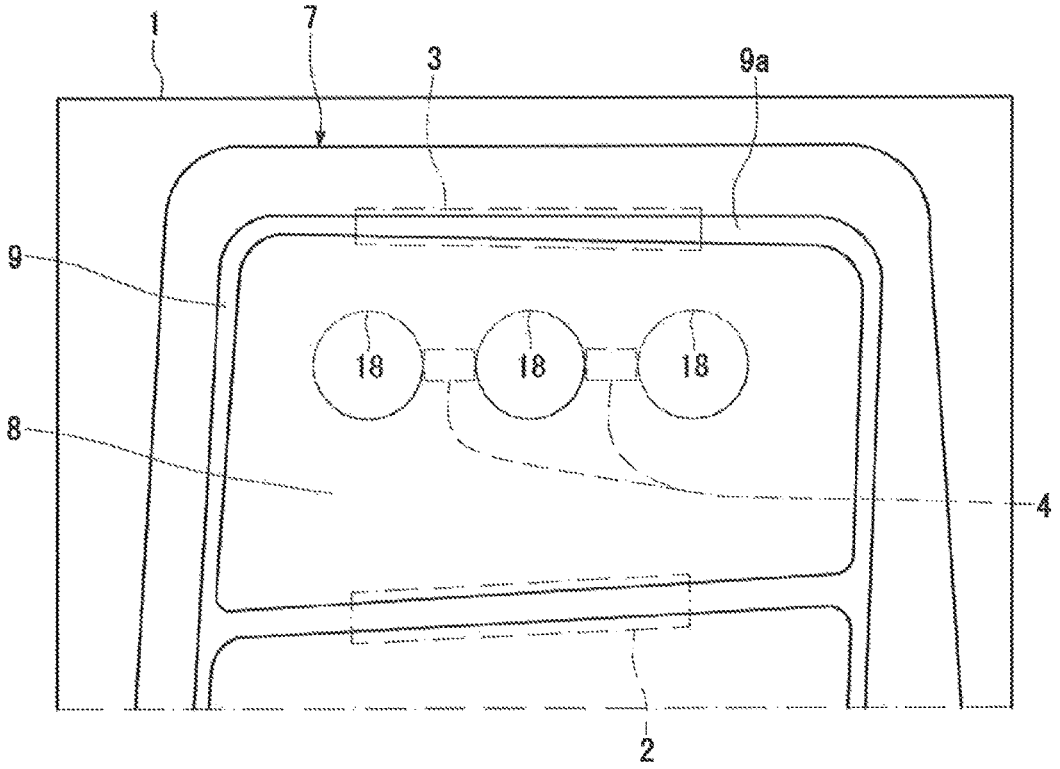
FIG. 11 is a plan view illustrating an example in which open holes are provided to create fracture parts so as to form a molding to be machined into a door inner panel.

For example, in the case where a plurality of open holes 18 are formed along a roof-side straight part 9*a* (a second part 3) of a frame-like pattern 9, as illustrated in FIG. 11, the areas sandwiched between the adjacent open holes 18 among the plurality of the open holes 18 will be the fracture parts 4. Further alternatively, the fracture part may be formed of a thinner part or the like of the plate material 1 in place of the slits 6 or the open holes 18.

DESCRIPTION OF REFERENCE NUMERALS

1 . . . Plate material; 2 . . . First part; 3 . . . Second part; 4 . . . Fracture part; 5 . . . Fracture; 6 . . . Slit; 7 . . . Molding; and 8 . . . Opening part.

What is claimed is:

1. A press drawing method for drawing a plate material, wherein the plate material has a first part, a second part, and an intermediate part lying between the first part and the second part, the method comprising:

applying a predetermined strain to the second part of the plate material by moving a metal mold from a first position to a fracture position while grasping the first part of the plate material, and causing a fracture to occur at a fracture part inside the intermediate part of the plate material;

before or during applying the predetermined strain to the second part of the plate material, providing a pair of slits or a plurality of open holes in the intermediate part of the plate material at a position so that the fracture part is formed in an area of the intermediate part sandwiched between the pair of slits or in an area of the intermediate part sandwiched between the adjacent open holes among the plurality of open holes; and drawing the second part of the plate material by moving the metal mold from the fracture position to a second position.

2. The press drawing method according to claim 1, wherein the second part is composed of a shallow drawing part and a deep drawing part;

the drawing of the second part is carried out such that the shallow drawing part is drawn to a first depth and the deep drawing part is drawn to a second depth, which is deeper than the first depth; and the shallow drawing part is adjacent to an intermediate part side of the deep drawing part.

3. The press drawing method according to claim 1, wherein:

the method further comprises, during the drawing of the second part, machining the plate material into a molding that has an opening and a frame pattern that encloses the opening;

the frame pattern is formed by the drawing of the second part; and the fracture part is positioned at a part of the intermediate part of the plate material that turns into the opening.

4. The press drawing method according to claim 1, wherein:

the method further comprises, during the drawing of the second part, machining the plate material into moldings that have openings and frame patterns that enclose the openings;

the frame patterns are formed by the drawing of the second part; and the fracture part is positioned at a part of the intermediate part of the plate material that turns into the openings, and the frame patterns are formed on the plate material such that the openings of the moldings are adjacent to each other, sandwiching corresponding frame patterns.

* * * * *